US006163102A

United States Patent [19]

Tucker et al.

[11] Patent Number: 6,163,102

[45] Date of Patent: Dec. 19, 2000

[54] REFLECTOR-TYPE LAMP ASSEMBLY HAVING A MULTI-PURPOSE CLOSURE MEMBER

[75] Inventors: Cynthia Holland Tucker, University Heights; Brian Louis Gordon, Lyndhurst; Scott Edward Wiley, Cleveland Heights, all of Ohio

[73] Assignee: General Electric Company, Schenectady, N.Y.

[21] Appl. No.: 09/075,609

[22] Filed: May 11, 1998

[51] Int. Cl.[7] ..... H01J 5/16; H01J 61/40

[52] U.S. Cl. ..... 313/113; 313/318.01; 313/318.03; 313/318.07

[58] Field of Search ..... 313/113, 623, 313/318.01, 318.03, 318.04, 318.1, 318.07

[56] References Cited

U.S. PATENT DOCUMENTS 4,012,658 3/1977 Vause ..... 313/318.07

4,959,583 9/1990 Arsena et al. .

5,057,735 10/1991 Zalar et al. .

*Primary Examiner*—Michael H. Day

*Assistant Examiner*—Karabi Guharay

*Attorney, Agent, or Firm*—Fay, Sharpe, Fagan, Minnich & McKee, LLP

[57] ABSTRACT

A new reflector lamp assembly exhibits an increased resistance to mechanical shock and vibration. A closure member that receives the lead wires of the light source therethrough is modified to include support legs that extend along a press seal region of the light source. The support legs provide mechanical support which increases the rigidity and durability of the assembly. Moreover, in one preferred embodiment an opening may be provided through the closure member for communication with recesses in the support legs to introduce a bonding material between the light source and the support legs.

12 Claims, 3 Drawing Sheets

REFLECTOR-TYPE LAMP ASSEMBLY HAVING A MULTI-PURPOSE CLOSURE MEMBER

BACKGROUND OF THE INVENTION

This invention pertains to the art of electric lamps and more particularly, to a reflector type lamp having improved resistance to mechanical shock and vibration. The invention is particularly applicable to a parabolic aluminized reflector (PAR) lamp and will be described with reference thereto. However, it will be appreciated that the invention has broader applications and may be advantageously employed in related environments and applications.

PAR lamps are well known in the art for providing general spot or flood lighting applications. These lamps commonly employ a light source mounted within an internal reflector cavity at a location approximately at the optical focal point of the reflector. The light source may be an incandescent source, such as a tungsten halogen light source, or an arc discharge light source such as a ceramic metal halide or CMH lamp. Of course other incandescent or discharge light sources have also been used.

The light source is typically secured with an adhesive at a narrowed end of the reflector cavity. That is, the light source is cantilever mounted in the reflector. A bonding material, such as a curable adhesive or cement, is used to secure the light source to the reflector in these types of lamp assemblies. This is the sole manner of mounting the light source in the reflector cavity and the arrangement must withstand mechanical shock and vibration both during lamp manufacture, shipment, and subsequent lamp service.

An auxiliary support is shown, for example, in commonly assigned U.S. Pat. No. 4,959,583, the disclosure which is hereby incorporated by reference. Another commonly owned patent, U.S. Pat. No. 5,057,735, illustrates a similar lamp assembly also intended to address the shock and vibration resistance of the assembled lamp unit. Again, the details of the '735 patent are hereby incorporated by reference. A closure member is interposed between the narrow end of the reflector cavity and the press seal region of the light source. The closure member is of reduced height and incorporates an exhaust passage for evacuating the reflector cavity, an arrangement that has met with widespread commercial acceptance.

Still another arrangement for securing the light source to the reflector, while addressing shock/vibration, enlarges the opening in the base of the reflector cavity and slides a thin metal closure member over the press seal region of the lamp base. This configuration allows the light source to be moved downwardly in the reflector whereby the source is more closely aligned with the focal point of the reflector.

Rather than modifying the lamp assembly, another proposed solution has been to improve shock and vibration resistance during shipment and handling by modifying the lamp packaging. However, as may be expected, the improved performance offered by the modified packaging adds to the overall cost of the lamp since the specialized packaging costs more. Moreover, modified packaging still does not resolve shock and vibration resistance concerns during assembly.

Accordingly, there is still a perceived need for improving the durability of the lamp assembly, particularly to mechanical shock and vibration, without an attendant significant increase in cost.

SUMMARY OF THE INVENTION

The present invention contemplates a new and improved lamp assembly that overcomes the above-referenced problems and others and provides a simple, economical solution to the problems associated with mechanical shock and vibration.

According to the present invention, a reflector lamp assembly includes a reflector defining an interior cavity that receives a light source therein. A closure member is associated with the light source and includes a slot that receives an axial portion of the light source and stabilizes the light source in the reflector.

According to another aspect of the invention, the slot is defined by first and second legs that include openings therethrough for communication with the reflector cavity.

According to yet another aspect of the invention, a bonding material is received in recesses formed in the legs to secure a portion of the light source thereto.

A principal advantage of the invention is to increase the resistance of the lamp assembly to mechanical shock and vibration.

Yet another advantage of the invention is the ability to save on packaging costs.

Still another advantage of the invention is found in the ease of assembling the lamp components together.

Still other advantages and benefits of the invention will become apparent to those skilled in the art upon a reading and understanding of the following detailed description.

BRIEF DESCRIPTION OF THE DRAWINGS

The invention may take physical form in parts and arrangements of parts, preferred embodiments of which will be described in detail in the specification. The embodiments are illustrated in the accompanying drawings which form a part of the invention.

DETAILED DESCRIPTION OF THE PREFERRED EMBODIMENTS

Figure 2:
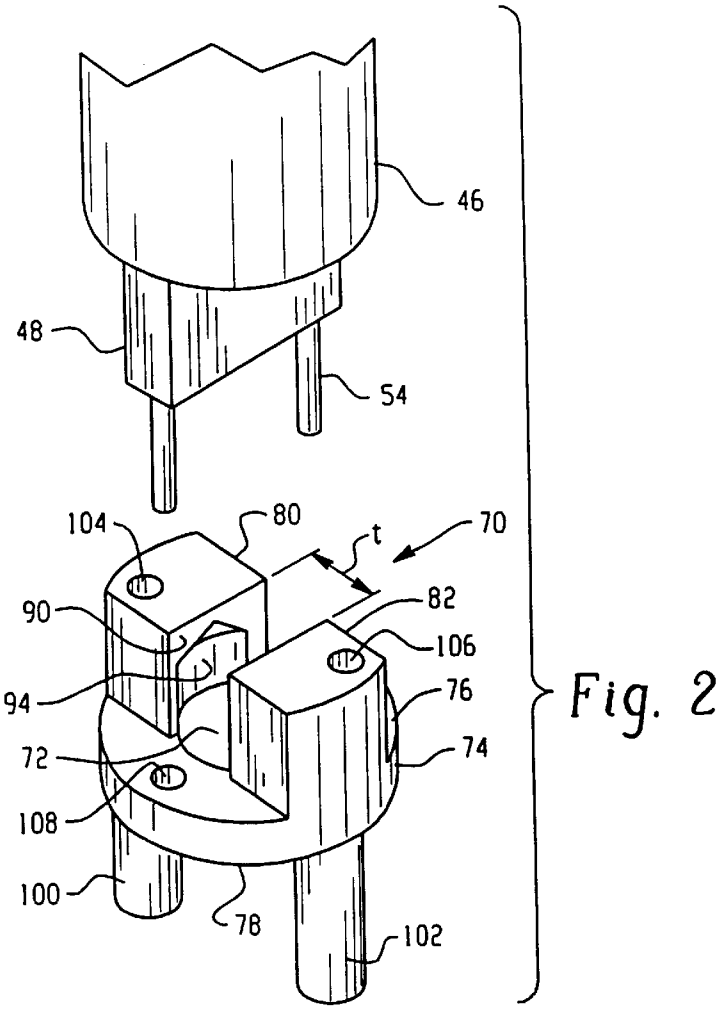
FIG. 2 is an exploded perspective view of selected components of the lamp assembly.

Referring now to the drawings wherein the showings are for the purposes of illustrating the preferred embodiments of the invention only and are not intended to limit the invention, the Figures show a lamp assembly A shown here as a parabolic aluminized reflector or PAR lamp.

The lamp A includes a reflector 20 that has a reflective coating 22 disposed along the inner surface thereof. The reflective surface can be a silver, aluminum, or dichroic coating that is applied using conventional techniques. The reflector is often a pressed glass configuration defined by an integral body having an enlarged first end 24 and a second or narrowed end 26. The first end 24 is closed by a lens 40 that is sealed about its perimeter to the first end of the reflector. Details of the seal structure and process of forming same are known in the art so that further discussion herein is deemed unnecessary to a full and complete understanding of the present invention.

The reflector defines an internal cavity 42 that receives a light source 44 such as a ceramic metal halide or other arc discharge light source, or an incandescent light source such as a halogen light source. Details of the light source are, again, generally known in the art so that beyond the general description of the source being either an incandescent or arc discharge type of source, further discussion is deemed unnecessary. Preferably, the light source is disposed as closely adjacent the focus of the parabolic reflector to provide a desired beam pattern. For example, lamps of this type can be used as flood lights or spot lights in both indoor and outdoor environments. In fact, a PAR type lamp is typically more efficient and provides a tighter, more defined beam pattern with a high center beam and/or peak candle power than known reflector lamps. The external capsule or envelope 46 is generally oriented along the longitudinal axis of the parabolic reflector. This disposes the light emitting filament or arc discharge adjacent the focus of the reflector surface.

A first end of the light source defines a seal, such as a press seal 48, which has a reduced cross-section relative to the remainder of the envelope. The lamp envelope is pressed or pinched along this seal region to hermetically seal the interior of the light source and maintain the fill pressure to achieve desired light efficacy characteristics. First and second electrical lead wires 54, 56 extend outwardly from the seal region of the light source. The leads provide an electrical connection to opposite ends of the arc discharge source or opposite ends of the filament light source. The lead wires 54, 56 extend outwardly from the light source through the press seal region where they are connected with first and second wires, often referred to as a top wire for electrical connection with a center eyelet, and a side wire which is electrically connected to a side of a metal base shell 62. A desired interconnection between these elements can be provided through conventional manners such as soldering, welding, staking, etc., and the screw base 62 is a conventional Edison-type base adapted for threaded insertion into a fixture. Again, details of the structural arrangement described above are generally well known in the art.

Figure 1:
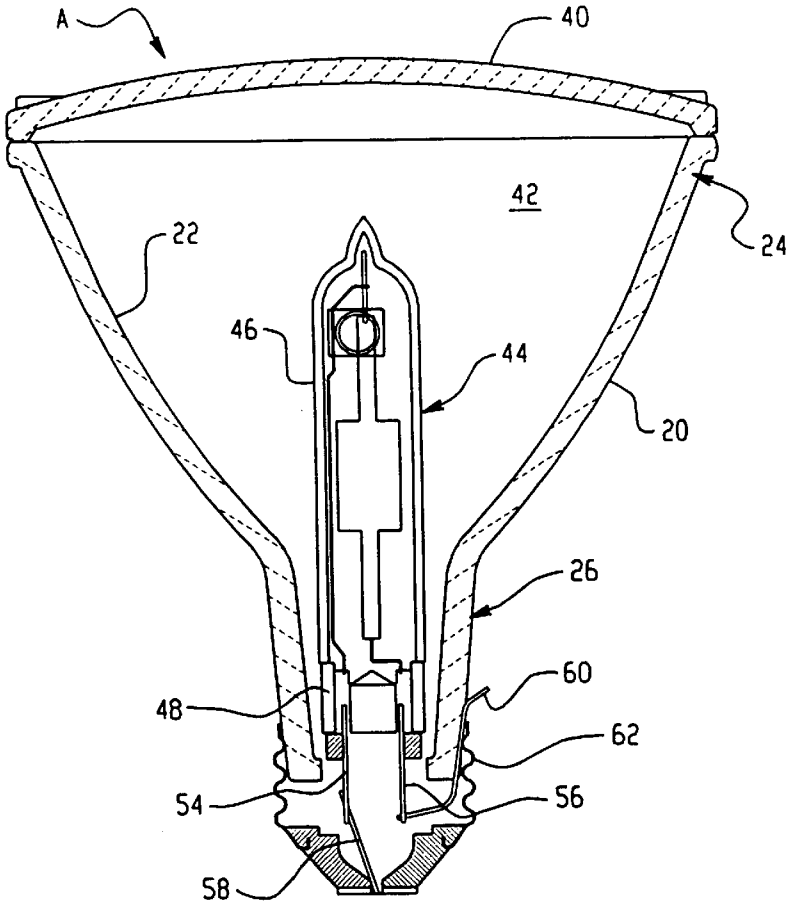
FIG. 1 shows a lamp assembly with selected components shown in cross-section for ease of illustration.
Figure 3:
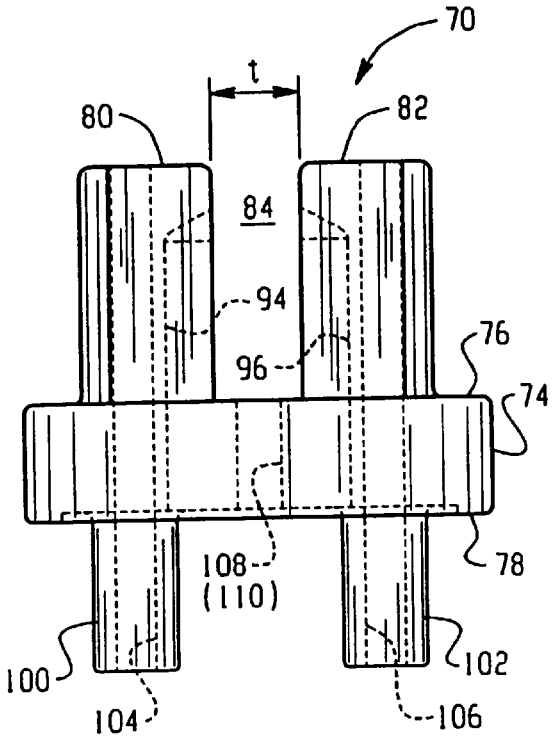
FIG. 3 is an elevational view of a first preferred embodiment of a closure member.
Figure 4:
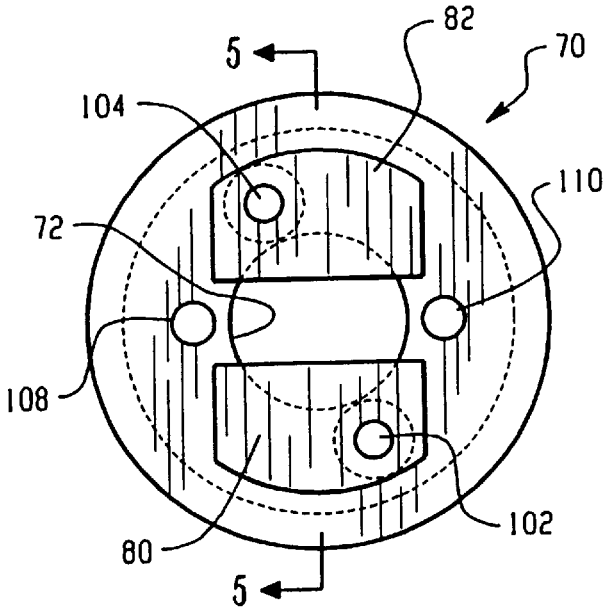
FIG. 4 is a top plan view of the closure member of FIG. 3.
Figure 5:
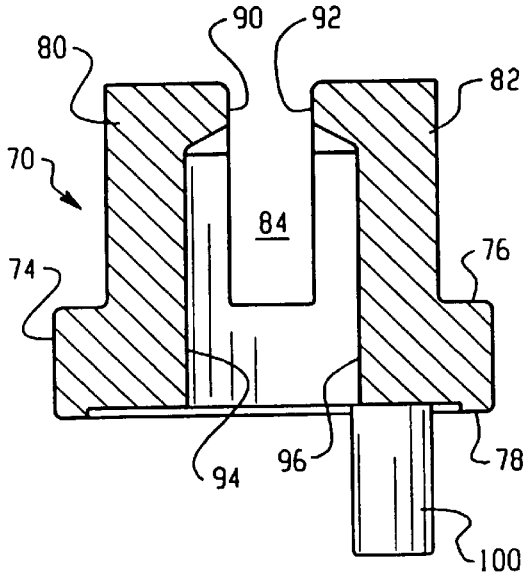
FIG. 5 is a cross-sectional view taken generally along the lines 5—5 of FIG. 4.

In accordance with the subject invention, a closure member (sometimes referred to as a button) formed of a refractory material is modified to provide improved resistance to mechanical shock or vibration while simultaneously providing access for the lead wires and communication with the reflector cavity. Particularly, with continued reference to FIG. 1 and additional reference to FIGS. 2–5, a first preferred embodiment of a closure member 70 is shown. The closure member has a generally annular configuration, a central opening 72 providing a communication passage for a bonding agent, details of which will be described further below. The closure member has a generally disk-like central portion 74 having substantially planar upper and lower faces 76, 78. Extending outwardly from the upper face 76 are a pair of support legs 80, 82. The support legs define a channel 84 therebetween having a dimension "t" that closely receives the press seal region 48 of the light source. Each of the support legs has a generally planar interior face 90, 92 and, in addition, recesses 94, 96 (FIGS. 3 and 5) are formed in the planar faces extending outwardly from the upper face 76 of the disk and terminating before the outer distal ends of the support legs.

Extending from the lower face 78 of the central portion are first and second extensions or chimneys 100, 102. Each chimney 100, 102 includes a through passage 104, 106, respectively, that extends entirely therethrough, continues through the disk portion 74, and also extends through the respective support legs 80, 82. These passages communicate with the sealed reflector cavity 42 inside the lamp assembly so that a vacuum can be applied to test the reliability of the seal formed between the lens and the reflector.

In addition, a pair of lead wire openings 108, 110 are provided through the central portion 78 of the closure member. As will be appreciated, the openings 108, 110 are dimensioned to receive the lead wires 54, 56 from the light source for connection with the top and side wires as described above.

The support legs 80, 82 extend outwardly from the central portion an axial extent closely approximating the height of the press seal region of the light source envelope. This allows the light source to be disposed deeply within the narrow end 26 of the reflector and assists in locating the arc discharge or filament at the focal point of the reflector. The chimneys extend outwardly through the central opening formed in the narrowed end of the reflector. As is conventional, the passages 104, 106 are left unobstructed during a subsequent bonding operation of the closure member to the reflector. This allows subsequent application of a vacuum through these openings to test that the lens is properly sealed to the reflector.

In this first preferred arrangement, a bonding agent, such as a curable adhesive or cement, is fed into the assembled closure member, light source, and reflector toward the lower surface 78 of the closure member. The bonding agent also proceeds through the central opening 72 in the closure member for communication with the recesses 94, 96 in the support legs. This distributes the bonding material along selected external surface portions of the press seal so that the light source is securely fixed to the closure member along the press seal region. Moreover, by terminating the passages 94, 96, the bonding material will not flow outwardly along the remainder of the light envelope.

The support legs provide mechanical support along an axial extent defined by the press seal region. Better support of the light source in all directions is achieved with this closure member and the effects of moment forces imposed on the light source as a result of its cantilevered mounting in the reflector are minimized. Moreover, the bonding material adds to the stability of the lamp to withstand shock and vibration that may be imposed on the lamp assembly.

Figure 6:
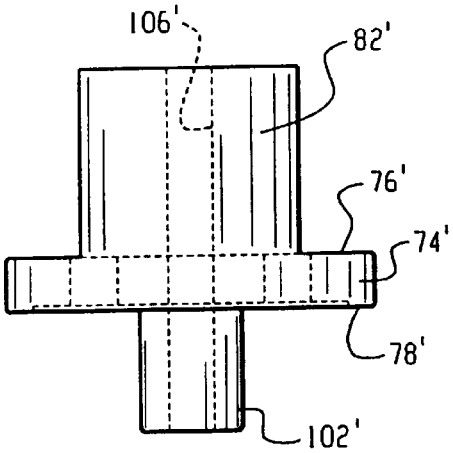
FIG. 6 is an elevational view of a second preferred embodiment of the closure member.
Figure 7:
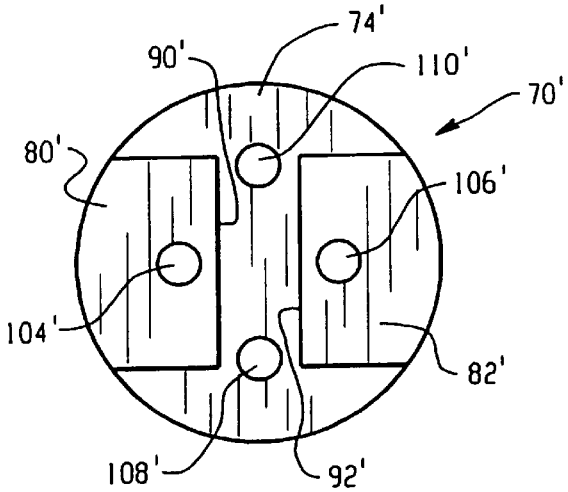
FIG. 7 is a top plan view of the embodiment of FIG. 6.

FIGS. 6 and 7 illustrate a second preferred embodiment that eliminates the central opening through the disk-like portion of the closure member. The closure member is otherwise substantially identical to the structure and function of the first embodiment described above. No central opening is provided in the closure member, and consequently no recesses are necessary in the support legs. The lead wire openings through the disk-like portion are maintained. Likewise, passages 104, 106 are also maintained through the support legs for applying a vacuum to the reflector cavity for reasons described above.

In this second preferred arrangement, a bonding material is still directed toward the lower surface of the closure member to secure the light source, reflector, and closure member together. The bonding material surrounds the exposed regions of the lead wires 54, 56 but does not proceed upwardly through the closure member toward the support legs. Again, this simplifies the structure and method of assembly of the lamp while still providing adequate mechanical support along the interface of the support legs and the press seal region of the light source.

The invention has been described with reference to the preferred embodiments. Obviously, modifications and alterations will occur to others upon a reading and understanding of the specification. For example, although the closure member is shown and described as being formed of a refractory material, such as a borosilicate, it is understood that still other materials can be used. Likewise, the conformation of the support legs, chimneys, and disk-like portion can be altered without departing from the scope or intent of the invention. The invention is intended to include all such modifications and alterations insofar as they come within the scope of the appended claims or the equivalents thereof.

Having thus described the invention, it is claimed:

1. A parabolic reflector lamp assembly comprising a reflector having an interior cavity having an enlarged first end and a narrowed second end having an opening therethrough, a light source received in the reflector cavity and mounted to the reflector at the second end, the light source including a reduced dimension seal at one end and first and second leads extending outwardly from the seal, and a closure member associated with the light source seal for securing the light source to the reflector, the closure member including first and second openings extending therethrough that receive the first and second leads, respectively, and a slot defined on a surface of the closure member that faces the light source and receives an axial portion of the seal for stabilizing the light source in the reflector;

the slot in the closure member being defined by first and second support legs extending axially inward toward the first end of the reflector, and at least one of the support least including an opening therethrough for communicating with the reflector cavity whereby a vacuum can be imposed on the cavity after assembly of the light source to the reflector.

2. The lamp of claim 1 wherein the closure member includes an opening for receiving a bonding material therethrough for securing the closure member and the light source together.

3. The lamp of claim 2 wherein at least one of the support legs includes a recess communicating with the bonding material opening for directing the bonding material to a region between the light source and the closure member.

4. The lamp of claim 3 wherein each of the support legs includes a recess communicating with the bonding material opening for directing the bonding material to a region between the light source and the closure member.

5. The lamp of claim 1 wherein the light source is an incandescent light source.

6. The lamp of claim 1 wherein the light source is an arc discharge source.

7. The lamp of claim 1 wherein the closure member is formed of a refractory material.

8. The lamp of claim 1 wherein the closure member includes a disk-like portion having at least one exhaust member extending outwardly from one surface of the disk-like portion and having an opening therethrough communicating with the reflector cavity for imposing a vacuum in the cavity.

9. The lamp of claim 8 further comprising first and second support legs extending outwardly from the disk-like portion of the closure member in a direction opposite the exhaust member.

10. The lamp of claim 9 wherein the support legs extend axially outwardly a dimension substantially equal to an axial dimension of the light source seal.

11. The lamp of claim 10 wherein the support legs are spaced apart a dimension substantially identical to a cross-sectional dimension of the light source seal.

12. A parabolic reflector lamp assembly comprising:

a reflector having an interior cavity having an enlarged first end and a narrowed second end having an opening therethrough;

a light source received in the reflector cavity and mounted to the reflector at the second end, the light source including a seal at one end and first and second leads extending outwardly from the seal; and a single piece closure member associated with the light source seal for securing the light source to the reflector, the closure member including first and second openings extending therethrough that receive the first and second leads, respectively, and first and second support legs extending from the closure member and defining a slot therebetween that is dimensioned to closely receive an axial portion of the seal for stabilizing the light source in the reflector; and at least one of the support legs including an opening therethrough for communicating with the reflector cavity whereby a vacuum can be imposed on the cavity after assembly of the light source to the reflector.

* * * * *

UNITED STATES PATENT AND TRADEMARK OFFICE

CERTIFICATE OF CORRECTION

PATENT NO. : 6,163,102
DATED : December 19, 2000
INVENTOR(S) : Tucker, et al.

It is certified that error appears in the above-identified patent and that said Letters Patent is hereby corrected as shown below:

Claim 1, column 5,
Line 34, delete the second occurrence of "least" and insert therefor -- legs --.

Signed and Sealed this

Twenty-third Day of October, 2001

*Attest:*

Nicholas P. Godici

NICHOLAS P. GODICI
*Acting Director of the United States Patent and Trademark Office*

*Attesting Officer*